US007953349B2

(12) United States Patent
Fukai

(10) Patent No.: US 7,953,349 B2
(45) Date of Patent: May 31, 2011

(54) FIXING APPARATUS AND IMAGE FORMING APPARATUS

(75) Inventor: Shougo Fukai, Hino (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 557 days.

(21) Appl. No.: 12/015,269

(22) Filed: Jan. 16, 2008

(65) Prior Publication Data

US 2008/0219726 A1 Sep. 11, 2008

(30) Foreign Application Priority Data

Mar. 7, 2007 (JP) ..... 2007-056844

(51) Int. Cl.
*G03G 15/22* (2006.01)

(52) U.S. Cl. ..... 399/122; 399/110; 399/320; 399/328; 219/216

(58) Field of Classification Search ..... 399/107, 399/110, 122, 320, 328–331; 219/216
See application file for complete search history.

(56) References Cited

U.S. PATENT DOCUMENTS 5,666,624 A * 9/1997 Kanesawa et al. ..... 399/329
6,795,678 B2 * 9/2004 Yura et al. ..... 399/329
2004/0151515 A1 * 8/2004 Nakayama ..... 399/67
2004/0161271 A1 * 8/2004 Tanino et al. ..... 399/329
2004/0184850 A1 * 9/2004 Yoneda et al. ..... 399/329
2006/0144545 A1 * 7/2006 Gustavsson et al. ..... 162/205
2007/0048044 A1 * 3/2007 Tokuhiro et al. ..... 399/329
2008/0175613 A1 * 7/2008 Fukai et al. ..... 399/67

FOREIGN PATENT DOCUMENTS

JP 2004-109878 4/2004
JP 2006-99144 4/2006

* cited by examiner

*Primary Examiner* — David P Porta
*Assistant Examiner* — Casey Bryant
(74) *Attorney, Agent, or Firm* — Finnegan, Henderson, Farabow, Garrett & Dunner, L.L.P.

(57) ABSTRACT

A fixing apparatus for fixing an toner image transferred onto a paper sheet, including: a fixing roller having a heater and an elastic layer on an external circumference surface thereof; a fixing belt driven by the fixing roller; a pressuring member which forms a nip portion between the fixing roller and the fixing belt; a separating member being arranged in a down stream of the pressuring member in a conveyance direction of a paper sheet, and being arranged to press the fixing belt; a pressing member which presses an edge of the separating member in a direction to which the fixing belt is pressed, and changes a position of the separating member relative to the fixing roller; and a plurality of adjusting members being provided in a longitudinal direction of the separating member and being arranged to adjust a position of the pressing member.

20 Claims, 6 Drawing Sheets

FIXING APPARATUS AND IMAGE FORMING APPARATUS

RELATED APPLICATION

This application is based on Japanese Patent Application No. 2007-056844 filed on Mar. 7, 2007 in Japanese Patent Office, the entire content of which is hereby incorporated by reference.

FIELD OF THE INVENTION

The present invention relates to a fixing apparatus, which has a fixing belt, and an image forming apparatus equipped with the fixing apparatus.

DESCRIPTION OF THE RELATED ART

In the image forming apparatus of electrophotography systems, such as a copying machine, a printer, a facsimile, and a multifunctional peripheral equipped with many of these functions, the latent image corresponding to a document is formed on a photoreceptive drum. And, by developing this latent image with a toner, a visualized toner image is transferred onto a paper sheet, the toner image is fixed onto the paper sheet and the paper sheet is ejected.

Moreover, when forming a color image, after forming the latent images of Y, M, C, and K corresponding to a document color on four photoreceptive drums, the visualized toner image of four colors are primarily transferred onto an endless intermediate transfer belt. Then, the toner images are secondarily transferred onto the paper sheet and the paper sheet is ejected.

As for a fixing apparatus for fixing a toner image, there is a fixing apparatus of a heat roller fixing system, in which a nip portion formed by a fixing roller including a heating device, such as a halogen lamp, and a pressuring roller for pressurizing the fixing roller, heats and pressurizes a paper sheet onto which the toner image has been transferred, with nipping and conveying the paper. Since configuration is simple, such a fixing apparatus is widely used.

By the way, in such a fixing apparatus, in order to attain improvement in the speed, it is necessary to supply sufficient quantity of heat for the toner and the paper sheet, and for that, it is necessary to make a nip width large. In order to make the nip width large, it is possible that a pressuring roller increases the load, which pressurizes the fixing roller, the thickness of the elastic layer formed from silicone rubber in a pressuring roller and the diameter of two rollers.

However, when the load of a pressuring roller and the thickness of an elastic layer are increased, there is a possibility that the nip width of an axial direction may become uneven and fixing unevenness and the wrinkles of the paper sheet may occur. Moreover, when the diameter of the roller is increased, not only the fixing apparatus is enlarged, but also there is a problem of warming up time becoming long.

In order to solve this problem, Unexamined Japanese Patent Application Publication No. 2004-109878 discloses a fixing apparatus of what is called a FBNF (Free Belt Nip Fuser) system for pressing a fixing belt in the direction to a fixing roller by a pressuring member, including, a fixing roller which has an elastic layer formed in the peripheral face by silicone rubber, contains a heating device of a halogen lamp in the center and rotates, an endless fixing belt which is driven by a fixing roller and rotates, and a pressuring member arranged at the inner circumference surface of the fixing belt.

According to this fixing apparatus, a fixing belt pressed to a fixing roller by a pressuring member is elastically deformed and a broad nip portion is formed between the fixing roller and the fixing belt. Therefore, it can respond to improvement of the speed, and also the fixing apparatus can be down sized. Furthermore, since the calorific capacity of the fixing belt is small, a warming up time is shortened and it becomes energy saving.

On the other hand, the paper sheet, which passed through the nip portion in fixing apparatus, may stick to a fixing roller by the adhesive force of a melting toner. In order to prevent this, in the fixing apparatus of a FBNF system, there a fixing apparatus, in which a separating member has been arranged, which presses a fixing belt in the direction to a fixing roller from the inner circumference surface side, makes a fixing belt contact to a fixing roller by pressure, and carries out elastic deformation of the elastic layer of the fixing roller in a down stream of the pressuring member in a conveyance direction of a paper sheet. It becomes possible to separate a paper sheet from a fixing roller without providing special separating members, such as a separation claw.

There is provided a pressure contact releasing device for pressing the fixing belt and a separating member and a pressuring member which are located inside the fixing belt, against the fixing roller by a spring when the fixing roller is used and for releasing pressure to a fixing roller by the fixing belt when the fixing roller is not used. The separating member is pressed to the fixing roller via a fixing belt with the spring of this pressure contact releasing device.

However, a pressure distribution in the longitudinal direction of the separating member does not become a constant value because of a minute variation of a part accuracy of the separating member, the smoothness of the related member which supports the separating member, and the deformation of the related member caused by the pressure.

With respect to this problem, since the pressure distribution of the separating member is lower on the central portion than that on the edge portion, in order to correct pressure distribution uniformly, the structure made into the convex curve shape where the edge portion of the separating member is lower than the central portion is disclosed by the Patent Gazette. However, specifying and processing such curved surface shape needs a great labor and cost. Then, suitably, a number of plates of the shims which are structured by a metal thin plate, are respectively changed and inserted into the longitudinal direction of the lower portion of the separating member, at the time of a trial production. A number of the plates of the shim are made to reflect at the time of mass production, the lower end of the separating member is formed into a step shape. This structure, which corrects pressure distribution, is disclosed.
(Refer to Unexamined Japanese Patent Application Publication No. 2006-99144).

With respect to the pressure distribution of the separating member, the above-mentioned structure disclosed in Japanese Patent Application Publication No. 2006-99144 is to correct the pressure distribution so as to be uniform in the longitudinal direction.

However, inventors of the present application examined the separatability of recording material in consideration of the thickness of a paper sheet and the variation of curl. As a result, it has been found by the inventors' investigation that the uniformity of the pressure distribution of the separating member is not necessarily the optimal in the longitudinal direction, and it is more desirable for a pressure distribution to be formed into a predetermined wave shape in the longitudinal direction. That is, a pressure distribution has desirable distribution by the thickness of a recording material and variation of curl, and if it is not this distribution, there is a possibility that a recording material is not securely separated from the fixing roller, or wrinkles and slant may occur with the recording material and there may be a risk of jam and a poor image occurring. Moreover, when a pressure distribution becomes asymmetry in left-and-right, a fixing belt causes a horizontal slippage in a width direction, and as a result a fixing belt may be damaged.

Moreover, a pressure distribution is influenced as above-mentioned by deformation of the related member by pressing, a flat-surface nature of the related member supporting the separating member, and the part accuracy of the separating member.

Therefore, since the part accuracy of the separating member which influences a pressure distribution, naturally differs in the time of several sets of trial productions and mass production, it is actually difficult to make a trial production result reflect in mass production, as disclosed in as Unexamined Japanese Patent Application Publication No. 2006-99144. For this reason, it becomes possible to obtain a desired pressure distribution to be close to a desired pressure distribution by changing the number of shims to be inserted into the longitudinal direction of the lower part of a separating member also in the time of mass production, rather than the way described above.

However, in this case, it becomes a work as the following.

First, after raising the separating member from the support plate for supporting the separating member located beneath the separating member, whether it is a desired pressure distribution or not is checked by inserting the number of thin shims in between the separating member and the support plate located thereunder, and by lowering the separating member to be in contact with the support plate. As a result, if it is not a desired pressure distribution, the separating member is raised from the support plate again. Furthermore, after inserting the shims to increase the number of shims or taking out the shims to decrease the number of shims, whether a desired pressure distribution has been obtained or not is checked by lowering the separating member to be in contact with the support plate. Such work must be repeated and a great operation man-hour is needed.

SUMMARY OF THE INVENTION

It is therefore an object of this invention is to provide a fixing apparatus, which is capable of setting a pressure distribution at a desired value by simply changing pressing force of a separating member in a longitudinal direction and an image forming apparatus including the fixing apparatus, even though there is variations of a part accuracy associated with a separating member and a related member.

An object of the present invention will be attained by the invention described below.

A fixing apparatus which fixes a toner image transferred onto a paper sheet, the fixing apparatus comprising:

a fixing roller including a heater and an elastic layer on an external circumference surface thereof;

a fixing belt driven by the fixing roller;

a pressuring member which forms a nip portion for fixing the toner image on the paper sheet between the fixing roller and the fixing belt by pressuring the fixing belt so as to make the fixing belt press the fixing roller from an inner circumference surface side of the fixing belt;

a separating member being arranged in a down stream of the pressuring member in a conveyance direction of a paper sheet, and being arranged to press the fixing belt from the inner circumference surface side so as to cause elastic deformation of the elastic layer of the fixing roller;

a pressing member which presses an edge of the separating member in a direction to which the fixing belt is pressed, and changes a position of the separating member relative to the fixing roller; and a plurality of adjusting members being provided in a longitudinal direction of the separating member, and being arranged to adjust a position of the pressing member.

And an image forming apparatus for forming an image on a paper sheet having:

an image forming section for forming a toner image; and a fixing apparatus which fixes a toner image transferred onto a paper sheet, the fixing apparatus comprising, a fixing roller including a heater and an elastic layer on an external circumference surface thereof;

a fixing belt driven by the fixing roller;

a pressuring member which forms a nip portion for fixing the toner image on the paper sheet between the fixing roller and the fixing belt by pressuring the fixing belt so as to make the fixing belt press the fixing roller from an inner circumference surface side of the fixing belt and;

a separating member being arranged in a down stream of the pressuring member in a conveyance direction of a paper sheet, and being arranged to press the fixing belt from the inner circumference surface side so as to cause elastic deformation of the elastic layer of the fixing roller;

a pressing member which presses an edge of the separating member in a direction to which the fixing belt is pressed, and changes a position of the separating member relative to the fixing roller; and a plurality of adjusting members being provided in a longitudinal direction of the separating member, and being arranged to adjust a position of each pressing member.

And a fixing apparatus which fixes a toner image transferred onto a paper sheet, the fixing apparatus comprising:

a fixing roller including a heater and an elastic layer on an external circumference surface thereof;

a fixing belt driven by the fixing roller;

a pressuring member which forms a nip portion for fixing the toner image on the paper sheet between the fixing roller and the fixing belt by pressuring the fixing belt so as to make the fixing belt press the fixing roller from an inner circumference surface side of the fixing belt and;

a separating member being arranged in a down stream of the pressuring member in a conveyance direction of a paper sheet, and being arranged to press the fixing belt from the inner circumference surface side so as to cause elastic deformation of the elastic layer of the fixing roller;

a plurality of pressing members which are provided in a longitudinal direction of the separating member, press an edge of the separating member in a direction to which the fixing belt is pressed, and change a position of the separating member relative to the fixing roller; and a plurality of adjusting members being provided in a longitudinal direction of the separating member, and being arranged to adjust a position of each pressing member.

BRIEF DESCRIPTION OF THE DRAWINGS

FIG. 3 (*b*) illustrates a fixing apparatus releasing pressure from the fixing belt to a fixing roller.

DESCRIPTION OF THE PREFERRED EMBODIMENT

An embodiment of a fixing apparatus of the present invention is described referring to drawings hereinafter.

Figure 1:
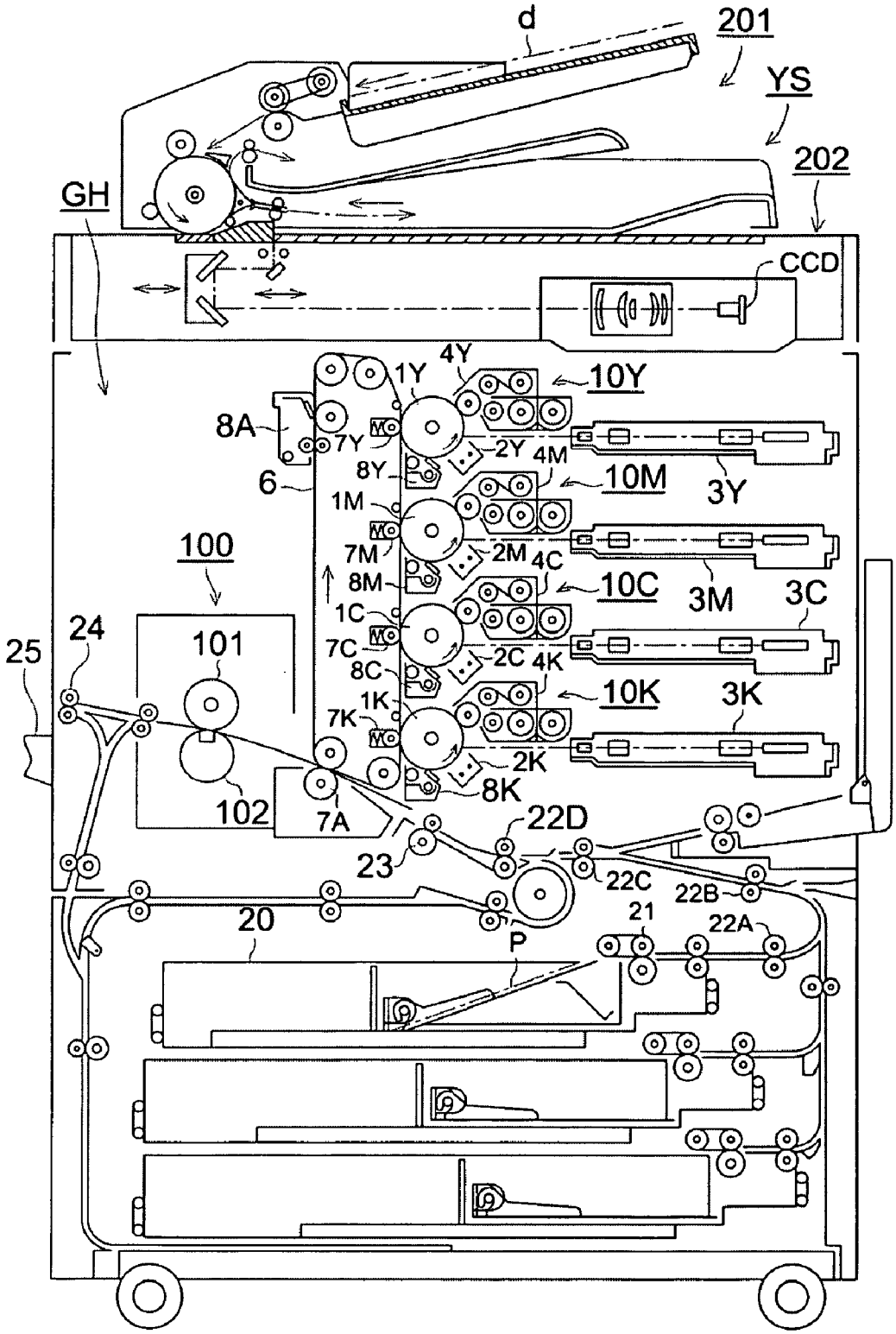
FIG. 1 illustrates a configuration diagram of an image forming apparatus.

First, an example of an image forming apparatus utilizing a fixing apparatus of the present invention is explained based on the configuration diagram of FIG. 1.

The image forming apparatus is configured by an image forming apparatus main body GH and an image reading apparatus YS.

The image forming apparatus main body GH is referred to as a tandem type color image forming apparatus, and includes a plurality set of image forming sections 10Y, 10M, 10C, and 10K, a belt-like intermediate transfer body 6, a sheet feed conveyance device, and a fixing apparatus 9.

An image reading apparatus YS configured by an automatic document feeding device 201 and a document image scanning exposure apparatus 202 is provided on the upper portion of the image forming apparatus body GH. A document d placed on a document tray of the automatic document feeding device is conveyed by a conveyance device and an image of one side or both sides of the document is scanned and exposed by an optical system of the document image scanning exposure apparatus 202. Then, the image is read into a line image sensor CCD.

In the image processing section, a signal formed from a photoelectric conversion by the line image sensor CCD is performed an analog processing, an A/D conversion, a shading correction, and an image compression processing. Then, the signal is transmitted to exposure device 3Y, 3M, 3C, and 3K.

In the image forming section 10Y for forming an image of yellow (Y) color, an electrostatic charge device 2Y, an exposure device 3Y, a development device 4Y, and a cleaning device 8Y are disposed around the photoreceptor drum 1Y. In the image forming section 10M for forming an image of magenta (M) color, an electrostatic charge device 2M, an exposure device 3M, a development device 4M, and a cleaning device 8M are disposed around the photoreceptor drum 1M. In the image forming section 10C for forming an image of cyan (C) color, an electrostatic charge device 2C, an exposure device 3C, a development device 4C, and a cleaning device 8Y are disposed around the photoreceptor drum 1C. In the image forming section 10K for forming an image of black (K) color, an electrostatic charge device 2K, an exposure device 3K, a development device 4K, and a cleaning device 8K are disposed around the photoreceptor drum 1K.

In addition, the development devices 4Y, 4M, 4C, and 4K comprise two component developer including a toner with particles having small diameters of yellow (Y), magenta (M), cyan (C) and black (K), and carrier.

The intermediate transfer body 6 is wound around a plurality of rollers and is rotatably supported.

The fixing apparatus 100 fixes a toner image on a recording sheet (recording material) P being heated and pressurized in the nip portion formed in-between a heated fixing roller 101 and a fixing belt 102.

In this way, an image of each color formed from the image forming sections 10Y, 10M, 10C, and 10K is transferred in order by transfer devices 7Y, 7M, 7C, and 7K onto the rotating intermediate transfer body 6 (primary transfer), and the toner image, which a color image synthesis has been conducted, is formed. The recording sheet P taken into a sheet-feeding cassette 20 is fed by a sheet-feeding device 21. The recording sheet P having gone through feed rollers 22A, 22B, 22C, 22D and registration roller 23 is conveyed to a transfer device 7A. Then, a color image is transferred onto the recording sheet P (secondary transfer). In the fixing apparatus 100, the recording sheet P having the color image transferred onto is heated and pressurized. Then, a color toner image on the recording sheet P is fixed. Then, the recording sheet P is nipped by sheet ejecting rollers 24 and placed on a sheet ejection tray 25 disposed on outside of the image forming apparatus.

Meanwhile, after the transfer device 7A transfers a color image onto the recording sheet P and the recording sheet P is separated in curvature manner from the intermediate transfer body 6, a residual toner on the intermediate transfer body 6 is removed by the cleaning device 8A.

In addition, the above mentioned was an image forming apparatus for forming a color image. However, the image forming apparatus may also form a monochrome image, and may or may not utilize an intermediate transfer body.

Figure 2:
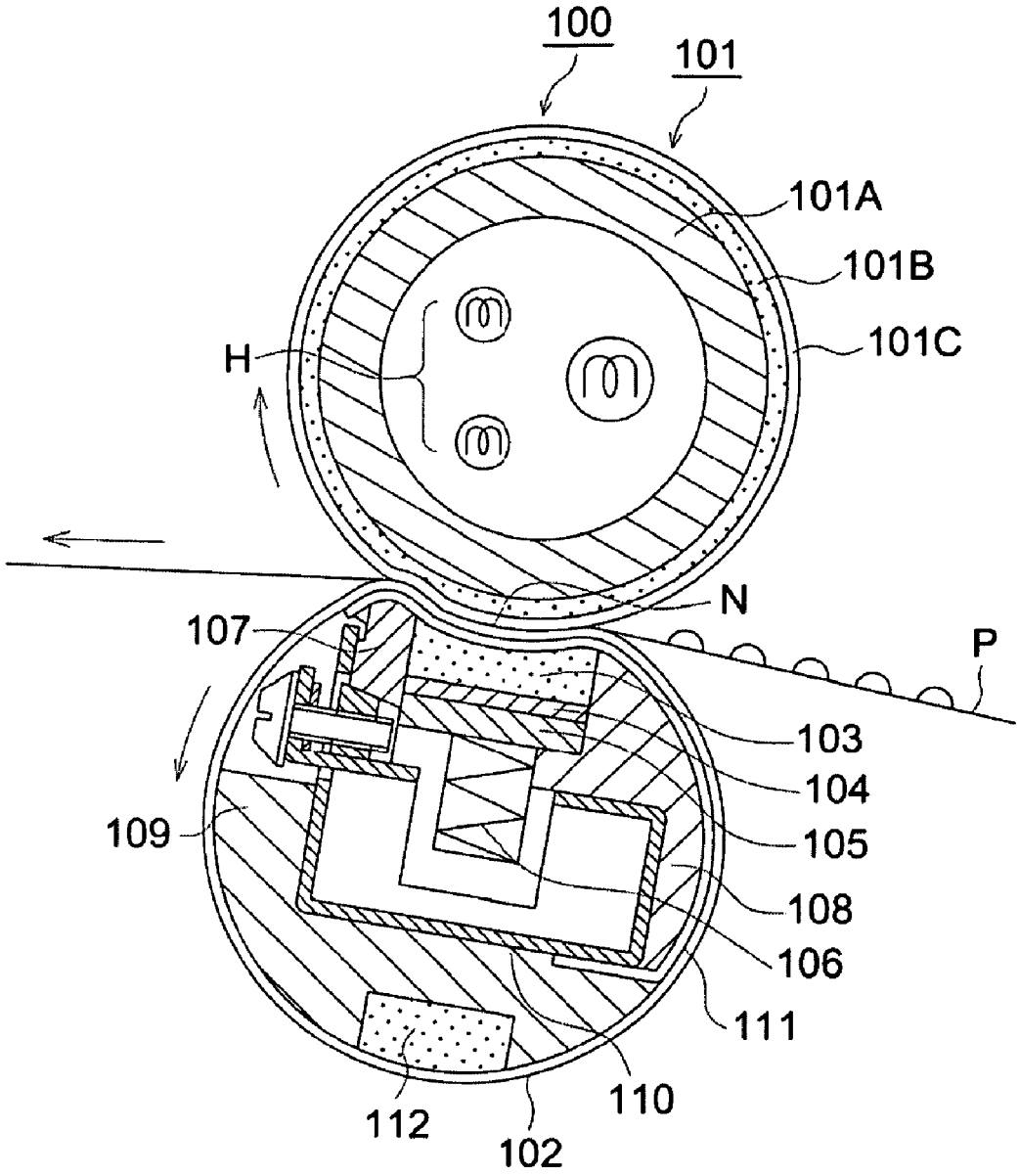
FIG. 2 illustrates a sectional view of a direction perpendicularly intersecting a longitudinal direction of a fixing apparatus.

Next, the embodiment of the main configuration of the fixing apparatus 100 of the present invention is explained with reference to FIG. 2. FIG. 2 illustrates a sectional view perpendicularly intersecting to a longitudinal direction of a fixing belt 102.

The halogen lamps (heating device) H are installed in the center of the fixing roller 101. The fixing roller 101 includes a cylindrical metal core 101A formed from aluminum or iron, an elastic layer 101B structured by high heat-resistant silicone rubber for covering the cylindrical metal core 101A, and, furthermore, a release layer 101C made from fluororesins, such as PFA (perfluoroalkoxy) or PTFE (polytetrafluoroethylene), for covering the elastic layer 101B.

The fixing belt 102 is configured by a base substance formed by polyimide about one hundred μm thick, and a release layer formed by PFA or PTFE about 25 μm thick for covering outer surface of the base substance. And the fixing belt 102 is formed in endless manner.

The pressuring member 103 is formed from a silicone rubber with hardness JISA about 10 degrees. The pressuring member 103 is supported by a holder 108 formed from heat-resistant resin along with a base metal 104 formed by stainless steel and a base member 105 formed from heat-resistant resin. Further, a compression spring 106 is disposed at the back surface of the base member 105.

A separating member 107 is disposed at lower stream side of a conveyance direction of the recording sheet P in order to improve a separatability of the fixed recording sheet P.

The separating member 107 utilizes heat-resistant resin or aluminum metal, and its leading edge section is formed in circular arc with large curvature. The separating member 107 is supported by the base sheet metal 104 and a holder 109 formed from heat-resistant resin.

A metal frame 110 disposed in the center supports the holders 108, 109.

A sliding member 111 is formed from a glass-fiber sheet and PTFE sheet of Teflon (registered trademark) coating. The sliding member 111 is disposed in between the inner circumference side of the fixing belt 102 and the pressuring member 103, and in between the inner circumference side of the fixing belt 102, and the separating member 107. One end of the sliding member 111 is being fixed to the metal frame 110.

An Oil pad 112 is formed from sponge consisting a lubricant from silicone oil. The Oil pad 112 is supported by the holder 109, and fixed onto the inner circumference side of the fixing belt 102 by applying pressure.

In addition, at the time of rotation of the fixing belt 102, the holder 108 guides the fixing belt 102 via the sliding member 111, and the holder 109 also has a function as a guide member for directly guiding the fixing belt 102.

In the fixing apparatus 100 configured in this way, the fixing roller 101, which is heated by the halogen lamps H and driven by a driving device, not illustrated, rotates clockwise. Further, the compression spring 106 pressurizes the pressuring member 103 via the base sheet metal 104 and the base member 105. And, the pressuring member 103 presses the fixing belt 102 from the inner circumference side via the sliding member 111 so as the fixing belt 102 is fixed onto the fixing roller 101 by applying pressure.

Accordingly, the fixing belt 102 rotates counterclockwise driven by the fixing roller 101, and is elastically deformed as pressed by the pressuring member 103. Therefore, the pressuring member 103 forms nip portion N for fixing the toner image on the paper sheet between the fixing roller 101 and the fixing belt 102 by pressuring the fixing belt so as to make the fixing belt press the fixing roller from an inner circumference surface side of the fixing belt. And, the unfixed toner on the conveyed recording sheet P is heated and pressurized, and is fixed in the nip portion N.

Further, the inner circumference side of the fixing belt 102 slides to the sliding member 111 when rotating. However, since the coefficient of friction of the sliding member 111 is small, a sliding resistance between the fixing belt 102 and the sliding member 111 is small. In addition since the silicone oil as lubricant from the oil pad 112 is supplied to the inner circumference side of the fixing belt 102, the sliding resistance becomes even smaller.

Further, the separating member 107 is arranged in a down stream of the pressuring member in a conveyance direction of a paper sheet and is arranged to press the fixing belt 102 onto the fixing roller 101 via the sliding member 111 from the inner circumference surface side so as to cause elastic deformation of the elastic layer 101B and the release layer 101*c* of the fixing roller 101. Therefore, the recording sheet P fixed in the nip section N exfoliates and separates from the fixing roller 101 without utilizing a separating claw.

Figure 3:
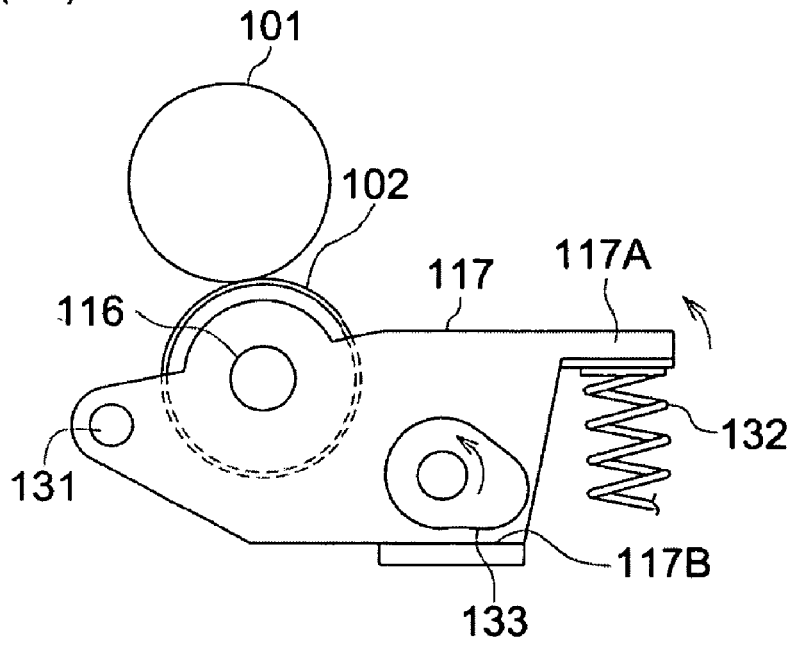
FIG. 3 (*a*) illustrates a condition at the time of a fixing apparatus in use.
Figure 3:
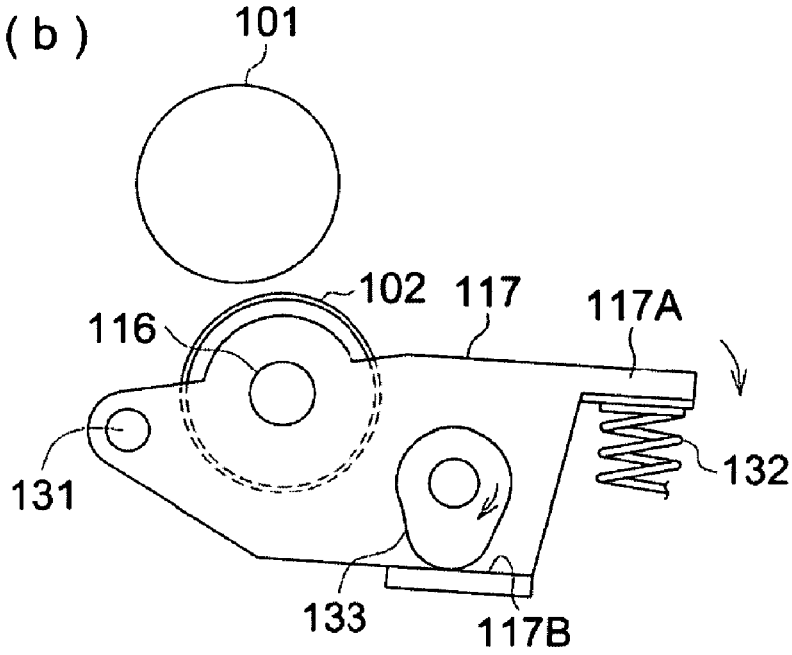

Here, a pressure contact release device for separating the fixing belt 102 along with the pressuring member 103 and the separating member 107 from the fixing roller 101 and for releasing a pressure contact from the fixing belt 102 to the fixing roller 101 is provided in case for shipment of the image forming apparatus, jam processing of a recording sheet, and maintenance. This pressure contact release device is explained with reference to FIG. 3 (*a*) and FIG. 3 (*b*). FIG. 3 (*a*) illustrates a state of the time of the fixing apparatus in activity, and FIG. 3 (*b*) illustrates a releasing of the pressure contact to the fixing roller 101 by the fixing belt 102.

In FIG. 3 (*a*), a pivot 131 pivotally supports a rotating member 117 so as to be capable of rotating. And, a compression spring 132 presses an edge section 117A of the rotating member 117, and the rotating member 117 is urged in counterclockwise. Accordingly, the fixing belt 102 also rotates through a support member 116, which supports the frame 110, and the fixing belt 102 contacts the fixing roller 101 with pressure.

Meanwhile, a cam 133 is rotated when releasing the pressure contact to the fixing roller 101 by the fixing belt 102 as shown in FIG. 3 (*b*). In case when a cam 133 rotates, the cam 133 presses a bottom section 117B of the rotating member 117, which rotates clockwise in resistance to the energization force of the compression spring 132. Therefore, the fixing belt 102 also rotates via the support member 106. Since the fixing belt 102 separates from the fixing roller 101, the pressure contact to the fixing roller 101 by the fixing belt 102 is released.

In the fixing apparatus 100 configured as above, in order to have the recording sheet P securely separated as described in "DESCRIPTION OF THE RELATED ART", it is preferable to set a pressure distribution of a longitudinal direction of the separating member 107 to a desired distribution. In addition, a pressure distribution is influenced by the part accuracy of the separating member 107, the flat-surface nature of the related member supporting the separating member, and deformation of the related member by pressing. Then, in case when the pressure distribution is not set to a desired distribution, the recording sheet P is not securely separated from the fixing roller 101, wrinkles occur on the recording sheet P, the recording sheet P horizontally slips against a conveyance direction, and there is a risk of sheet jam and image defect occurring.

Then, in this fixing apparatus 100, a position in a direction of the fixing roller 101 in the separating member 107 is configured so as to be capable of being adjustable in every predetermined position in a longitudinal direction, and the pressure distribution in the longitudinal direction of the separating member 107 is set so as to be able to set to a desired distribution.

Figure 4:
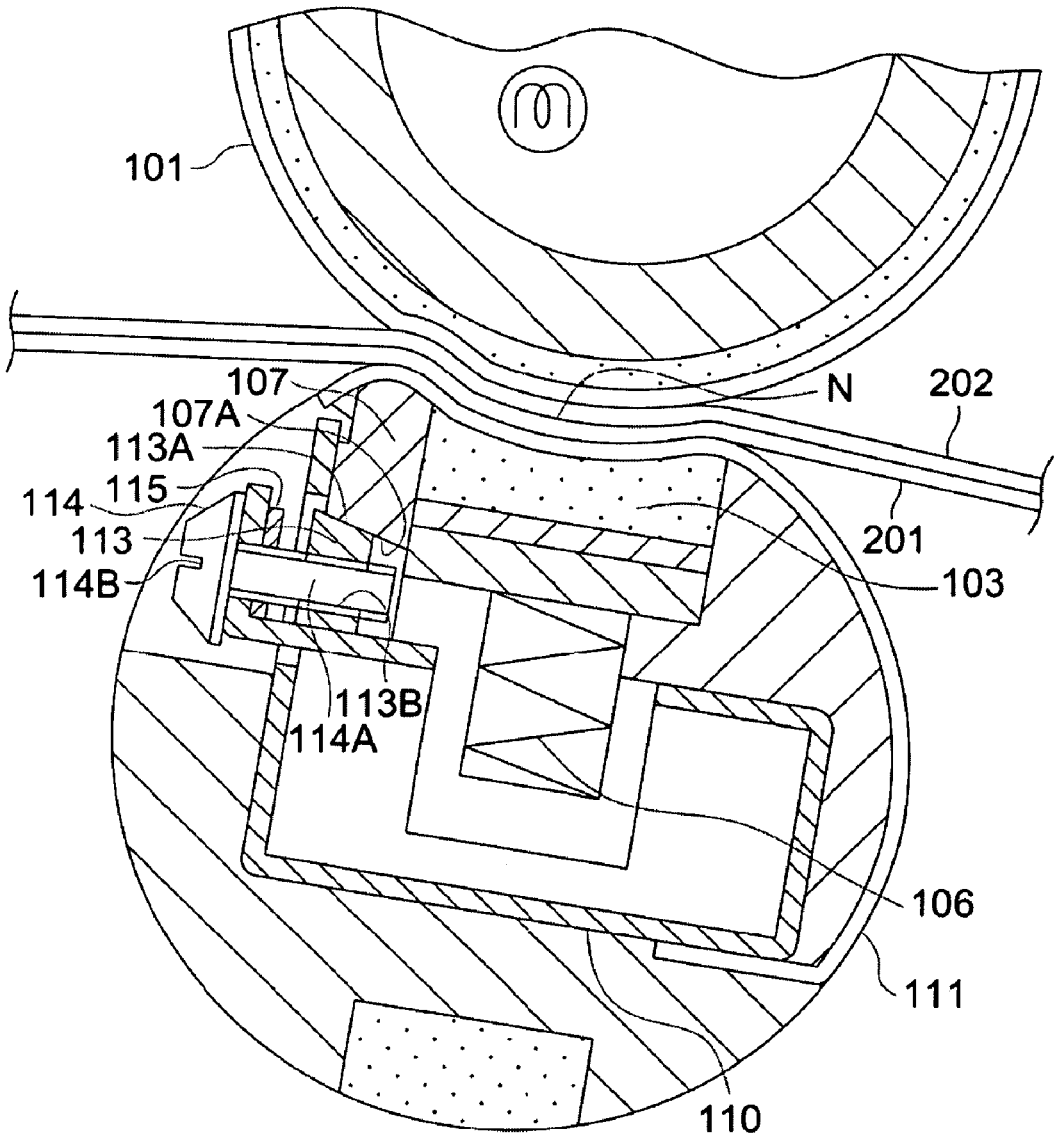
FIG. 4 illustrates an magnified sectional view of a separating member.

This configuration is explained with reference to FIGS. 4 and 5. FIG. 4 illustrates a magnified sectional view of the separating member 107, and FIG. 5 illustrates a longitudinal direction of the separating member 107.

First, in FIG. 4, a pressing member 113 which presses an edge of the separating member 107 in a direction to which the fixing belt is pressed is provided, and changes a position of the separating member relative to the fixing roller 101. Then, the edge section 107A pressed by the pressing member 113 in the separating member 107 is formed on an inclined surface. The pressing section 113A for pressing the separating member 107 in the pressing member 113 is also formed on an inclined surface.

In addition, in a direction perpendicularly intersecting a pressing direction of the pressing member 113, for example, a female screw 113B processed into a left screw is formed a threaded hole, and an adjustable screw 114 (adjustment member) having the female screw screwed with an external screw 114A is provided. Then, the external screw 114A of the adjustable screw 114 penetrates a left end of the frame 110. Furthermore, E ring 115 is hung on the adjustable screw 114 to prevent the adjustable screw 114 from slipping out.

Figure 5:
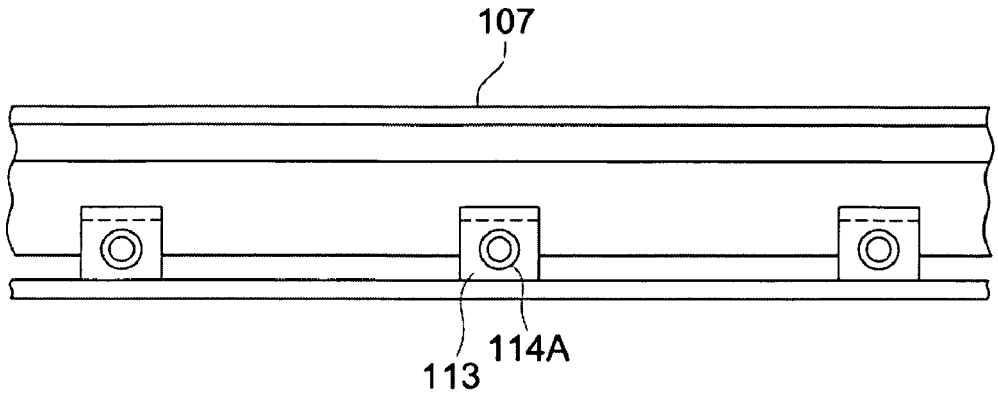
FIG. 5 illustrates a longitudinal direction of a separating member.

Further, as shown in FIG. 5, plurality of the pressing member 113 and the adjustable screw 114 are provided from the both end section to the center section of the longitudinal direction of the separating member 107. Then, the pressing member 113 is inserted into a concave portion, which is shaped in U character, provided in the separating member 107. Therefore, although the pressing member 113 is capable of moving in a direction perpendicularly intersecting with the longitudinal direction of the separating member 107, but the pressing member 113 cannot rotate.

Next, in this fixing apparatus 100, a method of adjusting the pressure distribution of the separating member 107 is explained.

After assembling the fixing apparatus 100 as the structure of the above explanation, leaving only the fixing belt 102 without setting. And instead of fixing belt 102, an adjusting belt 121, which is a belt like but not formed in the endless manner, having the same width, thickness, and quality of the material as the fixing belt 102 is inserted between the fixing roller 101 and the sliding member 111, the nip section N is formed, and the sensor sheet 122, which will be mentioned later, is inserted to this nip section N.

In this condition, a minus driver is to contact the slit 114B provided in the head of the adjustable screw 114, and the adjustable screw 114 is rotated clockwise. Then, the pressing member 113 is slid in the direction, which separates from the head of the adjustable screw 114. Then, the pressing section 113A, which is a slant surface in the pressing member 113, presses the edge section 107A, which is a slant surface of the separating member 107, and moves the separating member 107 in the direction of the fixing roller 101. Therefore, the separating member 107 presses the adjusting belt 121 and the sensor sheet 122 to the fixing roller 101 via the sliding member 111 and the pressing force, which causes the elastic deformation of the elastic layer 101B and the mold release layer 101C of the fixing roller 101, increases. A plurality of adjustment mechanisms is provided in the longitudinal direction of the separating member 107, and adjusts each adjustable screw 114.

In addition, in case when the adjustable screw 114 is rotated counterclockwise, the pressing member 113 slides in the direction approaching to the head of the adjustable screw 114, and the separating member 107 will retreat in the direction of the pressing member 113. Therefore, the pressing force to the fixing roller 101 decreases.

Here, the sensor sheet 122 is a sensor, which detects a pressure distribution. Two film state resin sheets structure the sensor sheet 122. A row electrode and a column electrode are arranged in a fixed spacing on each sheet, and pressure-sensitive conductivity ink is formed into a thin film shape on each electrode. And an intersection of the row electrode and the column electrode is set to be the point of measurement for detecting a pressure. At the time of no-load, the electric resistance value of the point of measurement is dramatically as large as several M (Mega) ohms. However, when a pressure is added to the sensor sheet 122, both electrodes will be pressed and the pressure-sensitive conductivity inks mutually contact each other by pressure. And the electric resistance value will decrease in inverse proportion to increase of the pressure. This electric resistance value is converted into digital data and inputted into a personal computer to detect the change of the resistance.

Therefore, when each adjustable screw 114 is properly adjusted by looking at a monitor of a personal computer, the pressure distribution of the longitudinal direction of the separating member 107 can be set to a desired distribution. When it is at a desired distribution, the adjustable screw 114 is fixed onto the frame 110 with adhesive agent, and the fixing belt 102 is set.

Moreover, in the above-mentioned adjustment mechanism, there is also an advantage that the pressing member 113 can regulate the position of the separating member 107 in the longitudinal direction.

Moreover, if correlation between a desired pressure distribution detected by utilizing a sensor sheet 122, and a torque of the driver, which rotates the adjustable screw 114, is acquired, the pressure distribution can be corrected to a desired pressure distribution, without managing the torque of a driver, utilizing the sensor sheet 122 and a personal computer, and even at the time of the components exchange by a serviceman.

Figure 7:
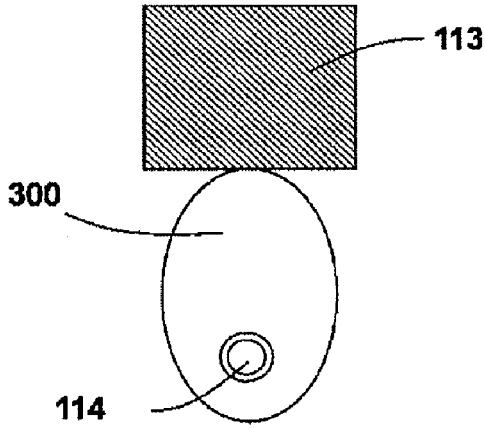
FIG. 7 illustrates an exemplary embodiment of an adjusting member.

In addition, a cam 300 may be rotated by the adjustable screw 114 and the pressing member 113 may be moved up and down by the rotation of this cam. FIG. 7 illustrates an adjusting member which includes the cam 300.

Figure 6:
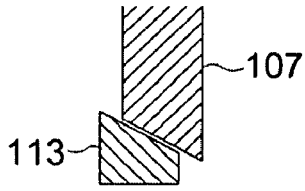
FIG. 6 (A), FIG. 6 (B), and FIG. 6 (C) illustrate configurations of an edge section of a separating member and pressuring section of a pressuring member.
Figure 6:
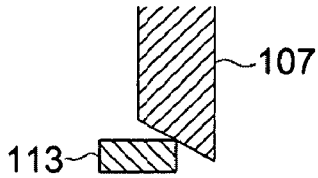
Figure 6:
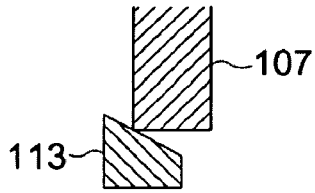

Moreover, a slant surface may be formed either on the edge section 107A of the separating member 107 or on the pressing section 113A of the pressing member 113 and a convex portion contacting the slant surface may be provided on the other one. For example, the configuration as shown in FIG. 6 (B) and a Fig. (C) may be allowed. FIG. 6 (A) illustrates an example, in which the slant portion is formed on the pressing section 113A of the pressing member 113 and on the edge section 107A of the separating member 107. FIG. 6 (B) illustrates an example, of a slant surface being formed on the edge section 107A of the separating member 107. FIG. 6 (C) illustrates an example of a slant surface being formed on the pressing section 113A of the pressing member 113.

Moreover, to have the pressing member 113 slide in the direction perpendicularly intersecting with a pressing direction is not necessarily limited to the adjustable screw 114 as described above. For example, the pressing member 113 may be slid from the lower part of FIG. 4 by the pressing of the eccentric screw, which is capable of being rotatably adjusted.

Furthermore, although not illustrated, the above-mentioned adjustment mechanism may be used for the pressure adjustment of the compression spring 106 for pressing the pressuring member 103. Thereby, the nip pressure of the longitudinal direction by the pressuring member 103 can be set at a desired pressure distribution and a better-fixed image can be obtained.

Since it is possible to change the pressing force of the longitudinal direction of a separating member by easy adjustment, and to set a pressure distribution as a desired value according to the fixing apparatus and an image forming apparatus of the present embodiment, it becomes possible to securely separate a recording material from a fixing roller. Moreover, since it can prevent that wrinkles from occurring in a recording material or a recording material from slipping in a horizontal direction against the conveyance direction, there is no possibility that jam and an image defect may occur. Furthermore, since the part accuracy of the separating member or a related component can be lowered comparing with prior technologies, cost down will be achieved.

What is claimed is:

1. An image forming apparatus for forming an image on a paper sheet, comprising:

an image forming section for forming a toner image; and a fixing apparatus which fixes the toner image transferred onto the paper sheet, the fixing apparatus comprising:

a fixing roller including a heater and an elastic layer on an external circumference surface thereof;

a fixing belt driven by the fixing roller;

a pressuring member which forms a nip portion for fixing the toner image on the paper sheet between the fixing roller and the fixing belt by making the fixing belt press the fixing roller from an inner circumference surface side of the fixing belt and;

a separating member arranged in a downstream side of the pressuring member in a conveyance direction of the paper sheet, and arranged to press the fixing belt from the inner circumference surface side so as to cause elastic deformation of the elastic layer of the fixing roller;

a plurality of pressing members provided in a longitudinal direction of the separating member, the pressing members pressing an edge of the separating member in a pressing direction in which the fixing belt is pressed and changing a position of the separating member relative to the fixing roller; and a plurality of adjusting members provided in a longitudinal direction of the separating member, and located at locations respectively corresponding to the pressing members, the adjusting members respectively adjusting positions of the pressing members, wherein at least one of the separating member and each pressing member has a slant surface, which is originally formed, at a position where the separating member and the pressing member contact each other.

2. The image forming apparatus according to claim 1, wherein one of the separating member and each pressing member is slidable on the slant surface formed in the other one of the separating member and each pressing member, and wherein the position of the separating member is changed in the pressing direction by adjusting the position of each pressing member in a perpendicular direction that is perpendicular to the pressing direction.

3. The image forming apparatus according to claim 2, wherein a female screw is formed at each pressing member in the perpendicular direction, an external screw screwed together with the female screw is provided at each adjusting member, and each pressing member is moved and changed position in the perpendicular direction by rotating the external screw.

4. The image forming apparatus according to claim 1, wherein each adjusting member comprises a cam.

5. A fixing apparatus which fixes a toner image transferred onto a paper sheet, the fixing apparatus comprising:

a fixing roller including a heater and an elastic layer on an external circumference surface thereof;

a fixing belt driven by the fixing roller;

a pressuring member which forms a nip portion for fixing the toner image on the paper sheet between the fixing roller and the fixing belt by making the fixing belt press the fixing roller from an inner circumference surface side of the fixing belt and;

a separating member arranged in a downstream side of the pressuring member in a conveyance direction of the paper sheet, and arranged to press the fixing belt from the inner circumference surface side so as to cause elastic deformation of the elastic layer of the fixing roller;

a plurality of pressing members provided in a longitudinal direction of the separating member, the pressing members pressing an edge of the separating member in a pressing direction in which the fixing belt is pressed and changing a position of the separating member relative to the fixing roller; and a plurality of adjusting members provided in a longitudinal direction of the separating member, and located at locations respectively corresponding to the pressing members, the adjusting members respectively adjusting positions of the pressing members, wherein at least one of the separating member and each pressing member has a slant surface, which is originally formed, at a position where the separating member and the pressing member contact each other.

6. The fixing apparatus according to claim 5, wherein one of the separating member and each pressing member is slidable on the slant surface formed in the other one of the separating member and each pressing member, and wherein the position of the separating member is changed in the pressing direction by adjusting the position of each pressing member in a perpendicular direction that is perpendicular to the pressing direction.

7. The fixing apparatus according to claim 6, wherein a female screw is formed at each pressing member in the perpendicular direction, an external screw screwed together with the female screw is provided at each adjusting member, and each pressing member is moved and changed position in the perpendicular direction by rotating the external screw.

8. The fixing apparatus according to claim 5, wherein each adjusting member comprises a cam.

9. An image forming apparatus for forming an image on a paper sheet, comprising:

an image forming section for forming a toner image; and a fixing apparatus which fixes the toner image transferred onto the paper sheet, the fixing apparatus comprising:

a fixing roller including a heater and an elastic layer on an external circumference surface thereof;

a fixing belt driven by the fixing roller;

a pressuring member which forms a nip portion for fixing the toner image on the paper sheet between the fixing roller and the fixing belt by making the fixing belt press the fixing roller from an inner circumference surface side of the fixing belt;

a separating member arranged in a downstream side of the pressuring member in a conveyance direction of the paper sheet, and arranged to press the fixing belt from the inner circumference surface side so as to cause elastic deformation of the elastic layer of the fixing roller;

a plurality of pressing members provided in a longitudinal direction of the separating member, the pressing members pressing an edge of the separating member in a pressing direction in which the fixing belt is pressed and changing a position of the separating member relative to the fixing roller; and a plurality of adjusting members provided in a longitudinal direction of the separating member, and located at locations respectively corresponding to the pressing members, the adjusting members respectively adjusting positions of the pressing members after the separating member and the pressing members are assembled into the fixing apparatus without disassembling the pressing members and the separating member from the fixing apparatus.

10. The image forming apparatus according to claim 9, wherein at least one of the separating member and each pressing member has a slant surface, which is originally formed, at a position where the separating member and each pressing member contact each other.

11. The image forming apparatus according to claim 10, wherein one of the separating member and each pressing member is slidable on the slant surface formed in the other one of the separating member and each pressing member, and wherein the position of the separating member is changed in the pressing direction by adjusting the position of each pressing member in a perpendicular direction that is perpendicular to the pressing direction.

12. The image forming apparatus according to claim 11, wherein a female screw is formed at each pressing member in the perpendicular direction, an external screw screwed together with the female screw is provided at each adjusting member, and each pressing member is moved and changed position in the perpendicular direction by rotating the external screw.

13. The image forming apparatus according to claim 9, wherein each adjusting member comprises a cam.

14. A fixing apparatus which fixes a toner image transferred onto a paper sheet, the fixing apparatus comprising:

a fixing roller including a heater and an elastic layer on an external circumference surface thereof;

a fixing belt driven by the fixing roller;

a pressuring member which forms a nip portion for fixing the toner image on the paper sheet between the fixing roller and the fixing belt by making the fixing belt press the fixing roller from an inner circumference surface side of the fixing belt;

a separating member arranged in a downstream side of the pressuring member in a conveyance direction of the paper sheet, and arranged to press the fixing belt from the inner circumference surface side so as to cause elastic deformation of the elastic layer of the fixing roller;

a plurality of pressing members provided in a longitudinal direction of the separating member, the pressing members pressing an edge of the separating member in a pressing direction in which the fixing belt is pressed and changing a position of the separating member relative to the fixing roller; and a plurality of adjusting members provided in a longitudinal direction of the separating member, and located at locations respectively corresponding to the pressing members, the adjusting members respectively adjusting positions of the pressing members after the separating member and the pressing members are assembled into the fixing apparatus without disassembling the pressing members and the eparating member from the fixing apparatus.

15. The fixing apparatus according to claim 14, wherein at least one of the separating member and each pressing member has a slant surface, which is originally formed, at a position where the separating member and each pressing member contact each other.

16. The fixing apparatus according to claim 15, wherein one of the separating member and each pressing member is slidable on the slant surface formed in the other one of the separating member and each pressing member, and wherein the position of the separating member is changed in the pressing direction by adjusting the position of each pressing member in a perpendicular direction that is perpendicular to the pressing direction.

17. The fixing apparatus according to claim 16, wherein a female screw is formed at each pressing member in the perpendicular direction, an external screw screwed together with the female screw is provided at each adjusting member, and each pressing member is moved and changed position in the perpendicular direction by rotating the external screw.

18. The fixing apparatus according to claim 14, wherein each adjusting member comprises a cam.

19. An image forming apparatus for forming an image on a paper sheet, comprising:

an image forming section for forming a toner image; and a fixing apparatus which fixes the toner image transferred onto the paper sheet, the fixing apparatus comprising:

a fixing roller including a heater and an elastic layer on an external circumference surface thereof;

a fixing belt driven by the fixing roller;

a pressuring member which forms a nip portion for fixing the toner image on the paper sheet between the fixing roller and the fixing belt by making the fixing belt press the fixing roller from an inner circumference surface side of the fixing belt and;

a separating member arranged in a downstream side of the pressuring member in a conveyance direction of the paper sheet, and arranged to press the fixing belt from the inner circumference surface side so as to cause elastic deformation of the elastic layer of the fixing roller;

a pressing member provided in a longitudinal direction of the separating member, the pressing member pressing an edge of the separating member in a pressing direction in which the fixing belt is pressed and changing a position of the separating member relative to the fixing roller; and an adjusting member provided in a longitudinal direction of the separating member, and located at a location corresponding to the pressing member, the adjusting member adjusting a position of the pressing member, wherein at least one of the separating member and the pressing member has a slant surface, which is originally formed, at a position where the separating member and the pressing member contact each other, wherein one of the separating member and the pressing member is slidable on the slant surface formed in the other one of the separating member and the pressing member, and wherein the position of the separating member is changed in the pressing direction by adjusting the position of the pressing member in a perpendicular direction that is perpendicular to the pressing direction, and wherein a female screw is formed at the pressing member in the perpendicular direction, an external screw screwed together with the female screw is provided at the adjusting member, and the pressing member is moved and changed position in the perpendicular direction by rotating the external screw.

20. A fixing apparatus which fixes a toner image transferred onto a paper sheet, the fixing apparatus comprising:

a fixing roller including a heater and an elastic layer on an external circumference surface thereof;

a fixing belt driven by the fixing roller;

a pressuring member which forms a nip portion for fixing the toner image on the paper sheet between the fixing roller and the fixing belt by making the fixing belt press the fixing roller from an inner circumference surface side of the fixing belt and;

a separating member arranged in a downstream side of the pressuring member in a conveyance direction of the paper sheet, and arranged to press the fixing belt from the inner circumference surface side so as to cause elastic deformation of the elastic layer of the fixing roller;

a pressing member provided in a longitudinal direction of the separating member, the pressing member pressing an edge of the separating member in a pressing direction in which the fixing belt is pressed and changing a position of the separating member relative to the fixing roller; and an adjusting member provided in a longitudinal direction of the separating member, and located at a location corresponding to the pressing member, the adjusting member adjusting a position of the pressing member, wherein at least one of the separating member and the pressing member has a slant surface, which is originally formed, at a position where the separating member and the pressing member contact each other, wherein one of the separating member and the pressing member is slidable on the slant surface formed in the other one of the separating member and the pressing member, and wherein the position of the separating member is changed in the pressing direction by adjusting the position of the pressing member in a perpendicular direction that is perpendicular to the pressing direction, and wherein a female screw is formed at the pressing member in the perpendicular direction, an external screw screwed together with the female screw is provided at the adjusting member, and the pressing member is moved and changed position in the perpendicular direction by rotating the external screw.

* * * * *